US007237877B2

(12) United States Patent
Sato et al.

(10) Patent No.: US 7,237,877 B2
(45) Date of Patent: Jul. 3, 2007

(54) DROPLET DISCHARGING DEVICE

(75) Inventors: Seiya Sato, Nagano-ken (JP); Ryuichi Kurosawa, Nagano-ken (JP)

(73) Assignee: Seiko Epson Corporation (JP)

( * ) Notice: Subject to any disclaimer, the term of this patent is extended or adjusted under 35 U.S.C. 154(b) by 159 days.

(21) Appl. No.: 10/985,670

(22) Filed: Nov. 11, 2004

(65) Prior Publication Data

US 2005/0179732 A1 Aug. 18, 2005

(30) Foreign Application Priority Data

Nov. 12, 2003 (JP) ..... 2003-382891

(51) Int. Cl.
*B41J 2/045* (2006.01)

(52) U.S. Cl. ..... 347/68; 347/71

(58) Field of Classification Search ..... 347/20, 347/44, 47, 56, 61, 63, 65, 67, 68, 70, 71, 347/12, 40, 42

See application file for complete search history.

(56) References Cited

U.S. PATENT DOCUMENTS

| | | | | |
|---|---|---|---|---|
| 4,558,333 | A * | 12/1985 | Sugitani et al. | 347/65 |
| 5,648,804 | A * | 7/1997 | Keefe et al. | 347/47 |
| 6,039,439 | A * | 3/2000 | Komplin et al. | 347/65 |
| 6,302,530 | B1 | 10/2001 | Shimada et al. | 347/86 |
| 6,464,345 | B2 | 10/2002 | Kubota et al. | 347/65 |

FOREIGN PATENT DOCUMENTS

| | | |
|---|---|---|
| EP | 1 186 416 | 8/2001 |
| EP | 1 186 417 | 8/2001 |
| EP | 1 291 084 | 9/2002 |
| JP | 07-0600958 | 3/1995 |
| JP | 10-193596 | 7/1998 |
| JP | 2001-191524 | 7/2001 |
| JP | 2001-225475 | 8/2001 |
| JP | 2002-052706 | 2/2002 |
| JP | 2002-86695 | 3/2002 |
| JP | 2002-86696 | 3/2002 |
| JP | 2003-231251 | 8/2002 |
| JP | 2002-286735 | 10/2002 |

(Continued)

OTHER PUBLICATIONS

Communication from Chinese Patent Office regarding counterpart application (and English translation thereof).

*Primary Examiner*—Juanita D. Stephens
(74) *Attorney, Agent, or Firm*—Harness, Dickey & Pierce, P.L.C.

(57) ABSTRACT

A small droplet discharging device is provided capable of producing high-density arrays. The droplet discharging device comprises a first substrate comprising a plurality of reservoir chambers for holding a liquid, a second substrate comprising a plurality of discharge units comprising supply openings for receiving a supply of a liquid stored in the reservoir chambers, pressurizing chambers for applying a pressure to the liquid supplied from the supply openings, and discharge openings for discharging the liquid pressurized in the pressurizing chambers to the outside, and a third substrate sandwiched between the first substrate and the second substrate and comprising channels for connecting the plurality of reservoir chambers with the plurality of supply openings corresponding thereto, wherein the plurality of supply openings provided in the second substrate are arranged such that relative positions thereof have a zigzag disposition.

8 Claims, 5 Drawing Sheets

FOREIGN PATENT DOCUMENTS

| | | |
|---|---|---|
| JP | 2003-72071 | 3/2003 |
| JP | 2003-154652 | 5/2003 |
| JP | 2003-182071 | 7/2003 |
| JP | 2003-254970 | 9/2003 |
| JP | 2003-287537 | 10/2003 |
| JP | 2004-003950 | 1/2004 |
| JP | 2004-061239 | 2/2004 |
| JP | 2004-066506 | 3/2004 |
| JP | 2004-077372 | 3/2004 |
| JP | 2004-101218 | 4/2004 |

* cited by examiner

100

DROPLET DISCHARGING DEVICE

RELATED APPLICATIONS

This application claims priority to Japanese Patent Application No. 2003-382891 filed Nov. 12, 2003 which is hereby expressly incorporated by reference herein in its entirety.

BACKGROUND OF THE INVENTION

The present invention relates to a droplet discharging device for discharging liquid drops of a very small amount, an apparatus for manufacturing a microarray and a method for manufacturing a microarray that use this droplet discharging device.

In recent years, decoding the base sequence of DNA and conducting functional analysis of genetic information became an important task, and DNA microarrays have been used as a technique for monitoring the gene expression patterns and screening new genes. With the array, the gene expression quantity is evaluated by preparing a probe DNA, high-density spotting on a substrate such as a slide glass, hybridizing a target DNA having a base sequence complementary with the probe DNA, of the fluorescent labeled target DNA, and observing the fluorescent pattern.

Further, a protein chip in which a protein is applied with a high density onto a substrate by employing the above-described technology has also been developed and used for expression analysis of proteins or analysis of protein interaction.

In order to manufacture such a microarray, a large number of probes have to be placed with a high density on a substrate. A method employing a droplet discharging device, for example, by using an ink-jet system, is such a method for placing a large number of probes on a substrate with a high density.

For example, Japanese Patent Application Laid-open No. 2002-286735 discloses a droplet discharging device comprising liquid supply openings arranged in the form of a matrix and connected with respective channels to a plurality of reservoir chambers arranged in the form of a matrix, wherein the arrangement pitch of the reservoir chambers is larger than the arrangement pitch of nozzle holes. With this droplet discharging device, the problem of increasing the degree of freedom in designing the nozzle spacing and the disposition spacing of the corresponding reservoir chambers was resolved by employing a multilayer configuration of channel substrates forming channels connecting the nozzles and the reservoir chambers.

However, because the channels in such a droplet discharging device have a multilayer structure, there is still space for improvement from the standpoint of device miniaturization.

SUMMARY

Accordingly, it is an object of the present invention to provide a small droplet discharging device capable of producing high-density arrays.

The present invention provides a droplet discharging device comprising a first substrate comprising a plurality of reservoir chambers (liquid reservoir chambers) for holding a liquid, a second substrate comprising a plurality of discharge units comprising supply openings for receiving a supply of the liquid stored in the reservoir chambers, pressurizing chambers for applying a pressure to the liquid supplied from the supply openings, and discharge openings for discharging the liquid pressurized in the pressurizing chambers to the outside, and a third substrate sandwiched between the first substrate and the second substrate and comprising channels for connecting the plurality of reservoir chambers with the plurality of supply openings corresponding thereto, wherein the plurality of supply openings provided in the second substrate are arranged such that relative positions thereof have a zigzag disposition.

With such a configuration, because the supply openings have a zigzag disposition, there is a high degree of freedom in selecting the width (channel width) of a channel itself, even if the prescribed width between the channels (wall thickness) is ensured. Therefore, excellent sealing ability between the channels is attained and the increase in channel resistance caused by restricting the channel width can be prevented. Further, because the supply openings have such a disposition, the degree of freedom in selecting the disposition of channels and reservoir chambers is increased and the droplet discharging device can be miniaturized.

It is preferred that the channels connected to the plurality of supply openings disposed in a zigzag fashion be formed alternately on both sides of the arrangement of the supply openings. With such a configuration, dispersing the channels makes it possible to dispose dispersedly the reservoir chambers connected thereto. Therefore, the droplet discharging device can be further miniaturized.

It is preferred that all the channels formed in the third substrate have an almost the same length. As a result, the difference in channel resistance caused by the spread in channel length can be reduced. Therefore, spread of discharge characteristics between the discharge openings (nozzles) can be prevented.

It is preferred that the second substrate comprise an electrode substrate having electrodes on the surface, a pressurizing chamber substrate disposed via a small gap opposite the electrode substrate and comprising pressurizing chambers with a pressure inside thereof adjusted by the displacement of diaphragms oscillating under the effect of an electrostatic force induced by the electrodes, and a nozzle substrate disposed on the opposite side of the pressurizing chamber substrate and having nozzle holes for discharging the liquid filling the pressurizing chambers to the outside. With such an electrostatic drive system, no heat is generated. Therefore, even when a solution containing a biological sample is used as the liquid for ejection, the effect of heat on the biological sample is prevented.

The drive system of the droplet discharging device is not limited to electrostatic drive and may be a piezoelectric drive system that generates no heat.

It is preferred that one of the first substrate and the third substrate be composed of glass, the other of the first substrate and the third substrate be composed of silicon, and the first substrate and the third substrate be bonded by anodic bonding. If the glass substrate and silicon substrate are thus used the main structural members, then it is possible to employ a lithographic technique that has been used in a semiconductor fabrication process or the like. Therefore, such substrates can be easily designed and processed. Further, anodic bonding uses no other elements such as adhesives during bonding. Therefore, the effect of other elements, such as contamination of the liquid by the admixture of the adhesive components, can be prevented.

Some of the channels may be formed in the first substrate. As a result, the degree of freedom in designing the channels is increased.

It is preferred that the channels formed in the first substrate and/or third substrate be formed by using a photolithography technology. With such a technology, fine channels can be easily processed. Furthermore, parameters can be changed by merely changing the pattern of the photomask, which is convenient from the standpoint of design changes.

The second aspect of the present invention is an apparatus for manufacturing a microarray comprising the above-described droplet discharging device and positioning means for adjusting relative positions of the droplet discharging device and the substrate for fixing the liquid drops discharged from the droplet discharging device.

With such a configuration, because the aforementioned miniature droplet discharging device is provided, the operability can be improved and a highly accurate microarray can be provided at a low cost.

The method for manufacturing a microarray in accordance with the present invention advantageously uses the discharging device for spotting various proteins on a chip for the fabrication of protein chips especially suitable for medical diagnostics.

The third aspect of the present invention is a method for manufacturing a microarray by which liquid drops are discharged onto a substrate and a microarray is manufactured by using the aforementioned droplet discharging device.

With such a configuration, because the aforementioned miniature droplet discharging device is provided, the operability can be improved and a highly accurate microarray can be provided at a low cost.

DETAILED DESCRIPTION

An embodiment of the present invention will be described below with reference to the drawings.

Figure 4:
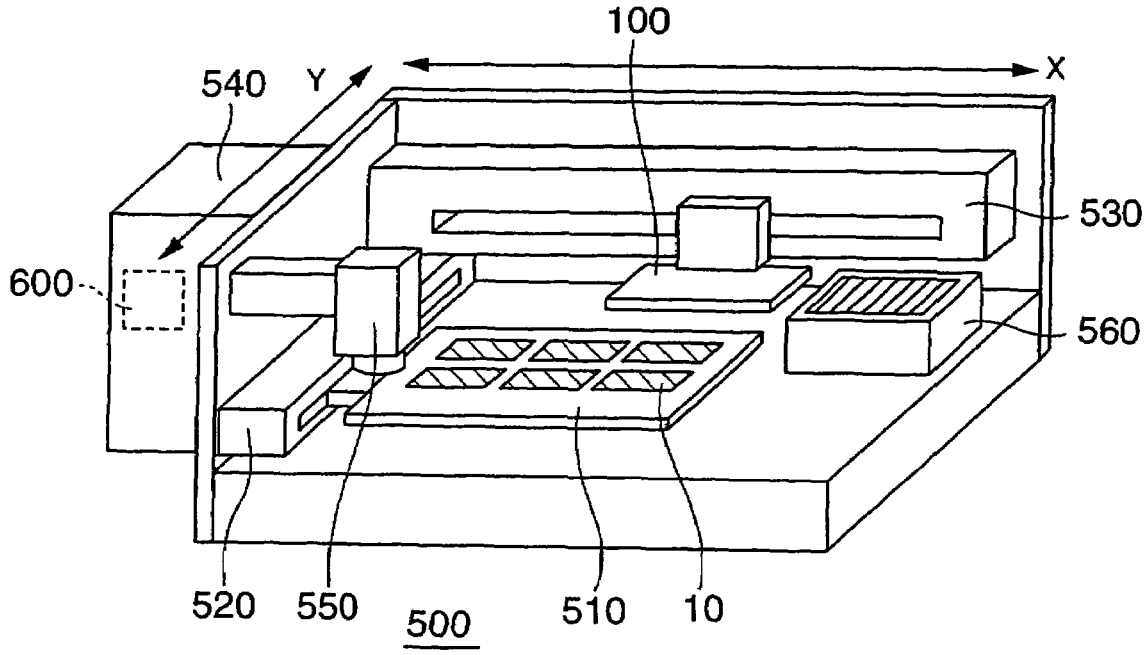
FIG. 4 illustrates the device for manufacturing a microarray of the present embodiment.

FIG. 4 illustrates the apparatus for manufacturing a microarray of the present embodiment.

An apparatus 500 for the manufacture of a microarray of the present embodiment is designed for the manufacture of a microarray in which a plurality of spots are disposed on a substrate 10 for microarray production and is composed of a table 510, an Y-direction drive shaft 520, a droplet discharging device 100, an X-direction drive shaft 530, a drive unit 540, and a control computer 600 as control means. The position control is conducted with the table 510, Y-direction drive shaft 520, X-direction drive shaft 530, drive unit 540, and control computer 600 (position control means).

The table 510 serves for carrying the substrate 10 constituting the microarray. The table 510 can carry a plurality of substrates 10 and is so composed that it can fix each substrate 10, for example, by vacuum chucking.

The Y-direction drive shaft 520 can freely move the table 510 along the Y direction shown in the figure. The Y-direction drive shaft 520 is connected to a drive motor (not shown in the figure) contained in the drive unit 540 and moves the table 510 by receiving the drive force from the drive motor.

The droplet discharging device 100 discharges a biological sample solution toward the substrate 10 based on a drive signal supplied from the control computer 600. The nozzle plane for discharging the solution is disposed on the X-direction drive shaft 530 so as to face the table 510. For example, a DNA or a protein is used as a biological sample contained in the biological sample solution. The configuration of the droplet discharging device 100 will be described hereinbelow in greater detail.

The X-direction drive shaft 530 serves to move freely the droplet discharging device 100 along the X direction shown in the figure. The X-direction drive shaft 530 is connected to a drive motor (not shown in the figure) contained in the drive unit 540 and moves the droplet discharging device 100 by receiving the drive force from the drive motor.

The drive unit 540 comprises motors or other drive mechanisms for driving the Y-direction drive shaft 520 and X-direction drive shaft 530. Those motors or mechanisms operate based on the drive signals supplied from the control computer 600, thereby controlling the relative positions of the droplet discharging device 100 and table 510 carrying the substrate 10.

The control computer 600 is disposed inside the housing of the drive unit 540, controls the operation (discharge timing of the solution, discharge frequency, and the like) of the droplet discharging device 100, and controls the operation of the drive unit 540.

The droplet discharging device of the present embodiment will be described hereinbelow with reference to FIG. 1 and FIG. 2.

Figure 1:
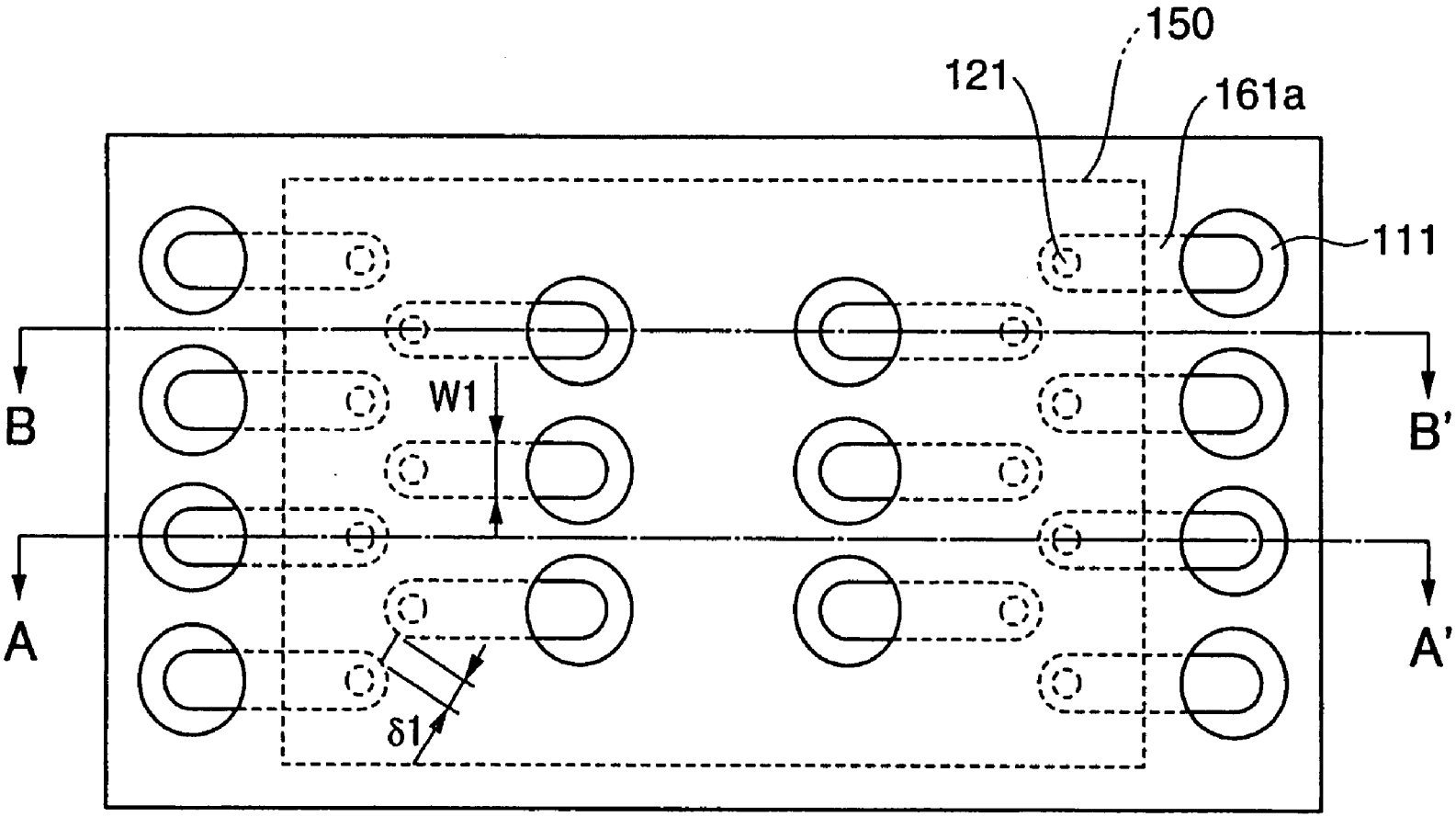
FIG. 1 is a plan view illustrating the droplet discharging device of the present embodiment.
Figure 2A:
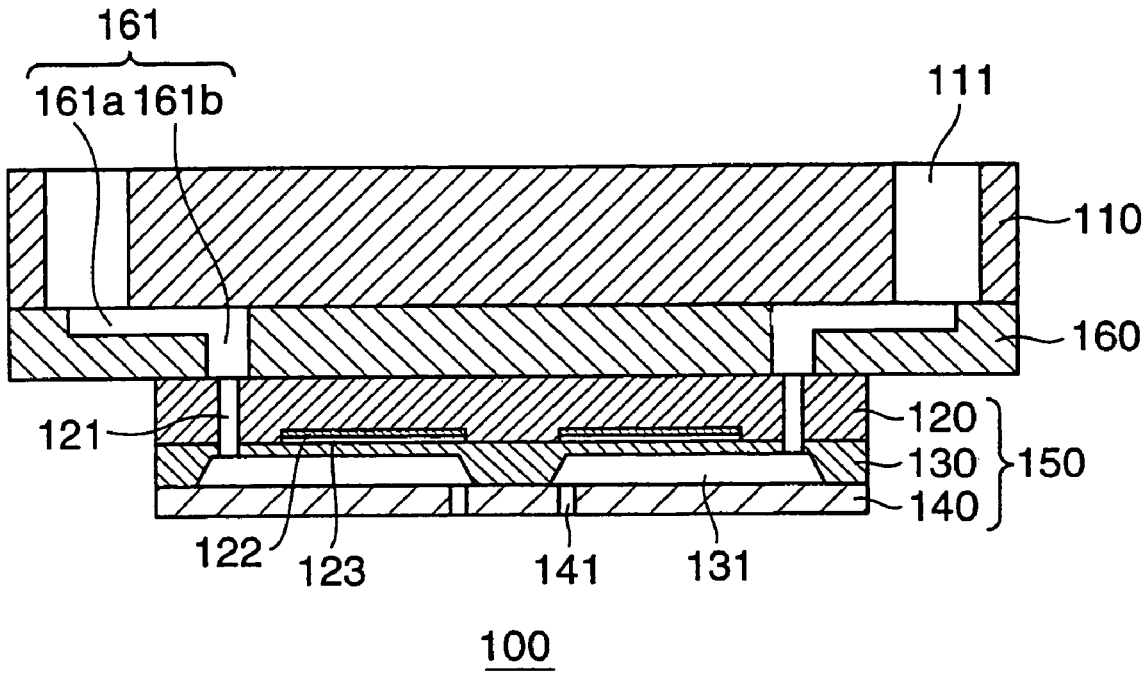
FIG. 2A is a cross-sectional view along the A–A' line in FIG. 1.
Figure 2B:
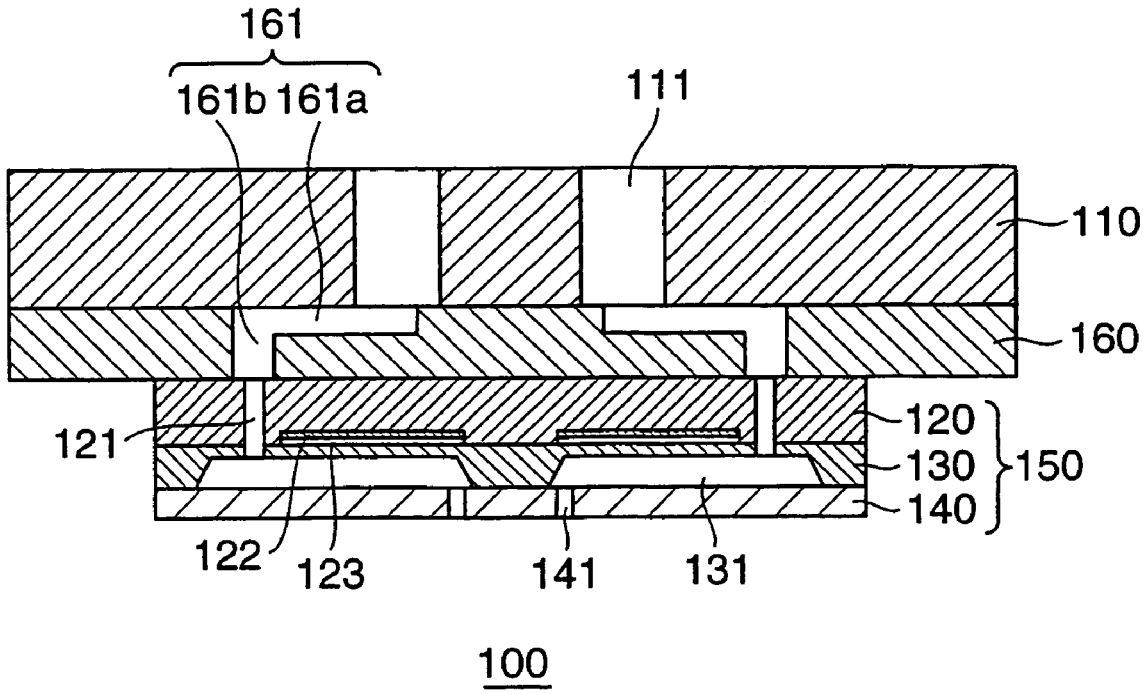
FIG. 2B is a cross-sectional view along the B–B' line in FIG. 1.

FIG. 1 is a plan view illustrating the droplet discharging device of the present embodiment. FIG. 2A is a cross-sectional view along the A–A' line in FIG. 1. FIG. 2B is a cross-sectional view along the B–B' line in FIG. 1.

The droplet discharging device 100 has a first substrate 110 comprising a plurality of liquid reservoir chambers (reservoir chambers) 111, a second substrate 150 comprising a plurality of pressurizing chambers 131 for applying a pressure to the liquid supplied from the liquid reservoir chambers 111, and a third substrate 160 comprising a plurality of channels 161 for connecting the liquid reservoir chambers 111 to corresponding pressurizing chambers 131.

The second substrate (head portion) 150 comprises an electrode substrate 120, a pressurizing chamber substrate 130, and a nozzle substrate 140.

The electrode substrate 120 comprises a plurality of recesses 123 in the surface facing the pressuring chamber substrate 130, and individual electrodes 122 are formed at the bottom surface of each recess 123. Further, supply openings 121 for introducing the liquid accommodated in the liquid reservoir chambers 111 to the pressurizing chambers 131 are formed in the electrode substrate 120.

The supply openings 121 are disposed in a zigzag fashion, when the second substrate 150 is viewed from the upper surface.

Figure 3A:
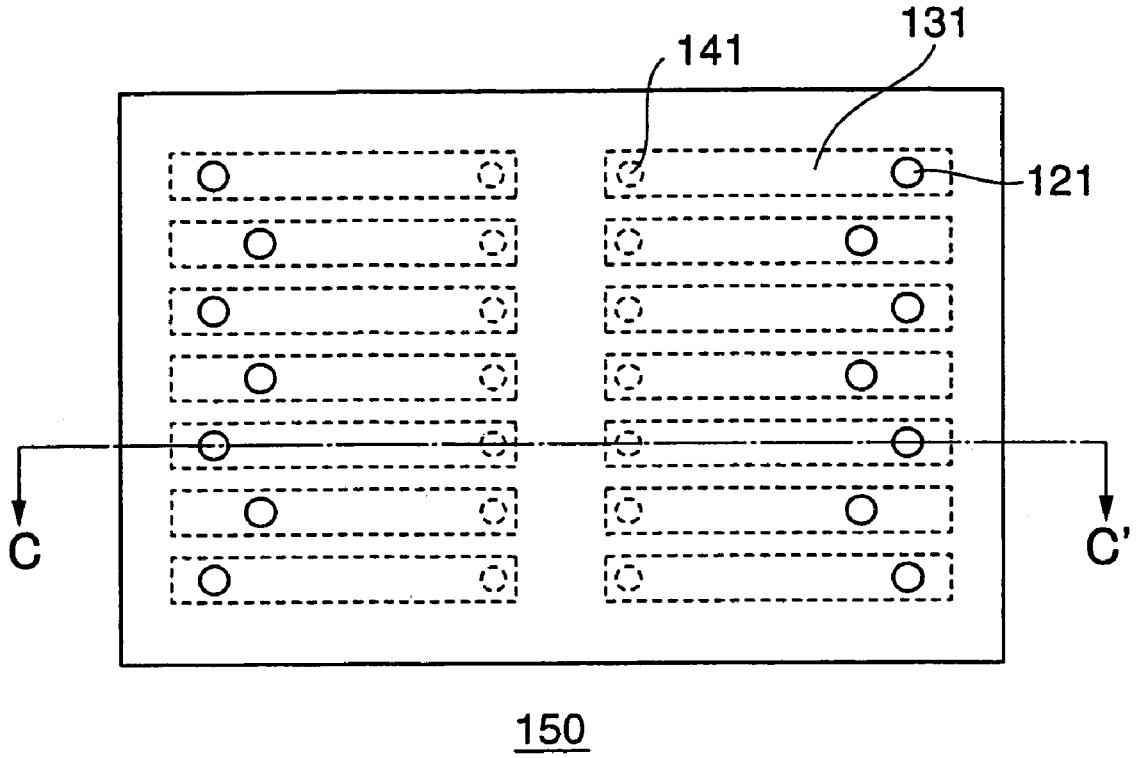
FIG. 3 illustrates the mutual arrangement of supply openings and nozzle holes in the head portion.
Figure 3B:
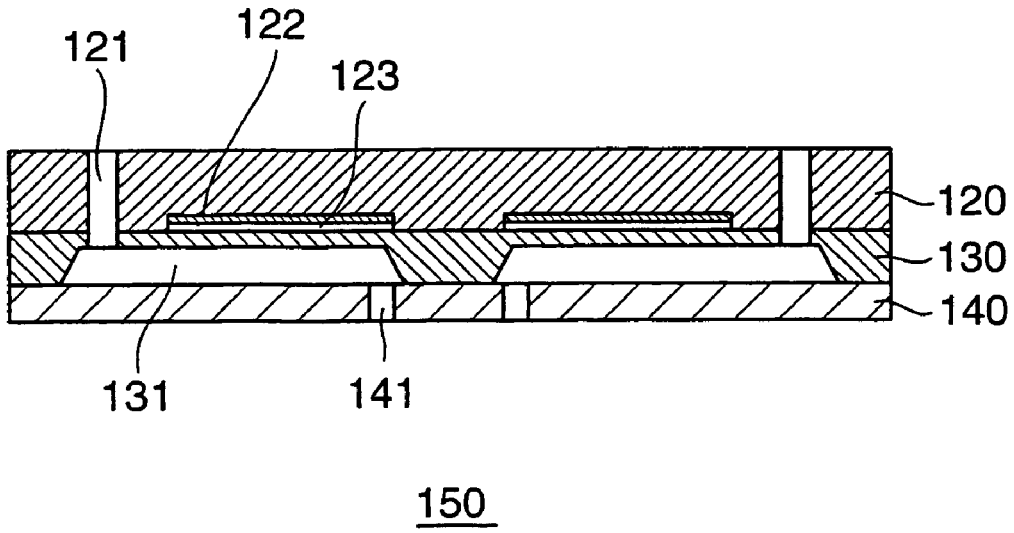

FIG. 3 shows mutual arrangement of the nozzle holes 141 and supply openings 121 in the second substrate. FIG. 3A is a plan view and FIG. 3B is a cross-sectional view along the C–C' line in FIG. 3A. As shown in FIG. 3A, in order to miniaturize the head, the supply openings 121 are disposed with a spacing almost equal to that of the nozzle holes 141. Furthermore, a plurality of supply openings 121 are disposed in a zigzag fashion so as to be displaced with respect to each other.

The pressurizing chamber substrate 130 comprises pressurizing chambers 131 for applying a force for pressing liquid drops to the outside. The bottom portion of the pressurizing chambers 131 are in the form of thin plates (diaphragms). If a voltage is applied from an external power source (not shown in the figure) to the common electrode (not shown in the figure) formed on the pressurizing chamber substrate 130 and an electrode 122 formed in the electrode substrate 120, then the bottom portion is pulled by an electrostatic force to the electrode substrate 120. If the voltage is thereafter switched off, the bottom portion returns to the original position. At this time, the pressure of the pressurizing chamber 131 temporarily increases and a liquid drop is thereby pushed to the outside.

The nozzle substrate 140 has discharge openings (nozzle holes) 141 for discharging the liquid pushed out of the pressurizing chambers 131 to the outside.

Such electrode substrate 120, pressurizing chamber substrate 130, and nozzle substrate 140 are composed, for example, of glass or silicon.

The third substrate 160 and the first substrate 110 are stacked on the second substrate 150 of the above-described configuration.

A plurality of liquid reservoir chambers 111 for holding (accommodating) a liquid are formed in the first substrate (reservoir chamber substrate) 110. The liquid reservoir chambers 111 are so disposed as to be positioned alternately on both sides of the supply openings 121 for the liquid in the second substrate 150, those openings being arranged in a zigzag fashion as shown in FIG. 1. Thus, because the liquid reservoir chambers 111 are disposed dispersedly with respect to the arrangement of supply openings 121, the space utilization efficiency is increased by comparison with the configuration in which the liquid reservoir chambers 111 are disposed in a row and the droplet discharging device 100 can be miniaturized.

The third substrate (channel substrate) 160 is disposed between the first substrate 110 and second substrate 150. The fine channels 161*a* extending in the plane direction and connecting the liquid reservoir chambers 111 and the supply openings 121 are formed in the surface of the third substrate 150 that faces the first substrate 110. The channels 161*a* descend vertically above the supply openings 121 and are connected to the supply openings 121. For example, a silicon substrate can be used as the third substrate 160, and fine channels 161*a* are formed, for example, by using photolithography.

It is preferred that the first substrate and third substrate be bonded by anodic bonding, but this condition is not limiting. If they are thus bonded by anodic bonding, it is not necessary to introduce an adhesive or the like therebetween and the effect produced on biological samples is small. However, it does not mean that bonding with an adhesive is excluded from the scope of the present invention. Thus, the substrates may be bonded with an adhesive. In this case, it is preferred that an adhesive be selected which produces little effect on biological sample. When anodic bonding is employed, a glass substrate, more specifically, borosilicate glass substrate is used as the first substrate.

FIG. 1 shows a mutual arrangement of the first substrate 110 (or third substrate 160) and second substrate 150, in particular, a mutual arrangement of the supply openings 121, channels 161*a*, and liquid reservoir chambers 111. When the channels 161*a* are formed by laminating together the substrates in which fine grooves were formed, as in the droplet discharging device 100 of the present embodiment, the prescribed wall thickness (δ) has to be ensured in order to provide for sealing between the adjacent channels 161*a*. However, when the channels are arranged in the same direction, if the necessary wall thickness (δ) is ensured, the channel width (W) decreases and channel resistance increases. In the present embodiment, the prescribed wall thickness δ1 between the channels can be provided, without reducing the width W1 of the channels 161*a*, by disposing the supply openings 121 in a zigzag fashion and forming the channels 161*a* alternately on both sides of the arrangement of the supply openings 121. Furthermore, disposing the supply openings 121 in a zigzag fashion makes it possible to disperse the liquid reservoir chambers 111 on both sides of the arrangement of the supply openings 121 and increases the degree of freedom in designing the disposition of the liquid reservoir chambers 111 and channel width. Further, because the distance of the channels from the liquid reservoir chambers 111 to supply openings 121 can be formed almost the same for all the channels, the spread of discharge characteristic between the nozzles caused by spread in the channel length can be prevented.

With the present embodiment, even if the prescribed value of the width (thickness of the wall portion) δ1 between the channels 161*a* is ensured by disposing the supply openings 121 in a zigzag fashion, because the degree of freedom in selecting the width (channel width) W1 of the channels 161*a* themselves is high, excellent sealing between the channels is obtained and the increase in channel resistance caused by restricting the channel width can be prevented. Moreover, since the length of all the channels is the same, spread of discharge characteristic between the nozzles can be prevented. Further, disposing the channels 161*a* and liquid reservoir chambers 111 alternately on both side of the arrangement of the supply openings provides for dispersed disposition of the channels 161*a* and liquid reservoir chambers thereby enabling the miniaturization of the droplet discharging device 100. Therefore, an inexpensive droplet discharging device with good operability can be provided.

Further, if a microarray is produced by using such a droplet discharging device, the microarray with good accuracy can be provided at a low cost.

In the present embodiment, a glass substrate was used as the first substrate and the silicon substrate was used as the third substrate, but such a configuration is not limiting and a silicon substrate may be used as the first substrate and a glass substrate may be used as the third substrate. Further, this combination of the materials is also not limiting.

Further, in the above-described embodiment, an example was considered in which the channels were formed on the third substrate 160, but such a configuration is not limiting and some of the channels may be formed on the first substrate 110. More specifically, only the channels 161*b* in the vertical direction which are connected to the supply openings 121 may be formed in the third substrate 160, and the channels 161*a* in the horizontal direction may be formed in the rear surface (the surface facing the third substrate 160) of the first substrate 110. In this case, it is preferred that the first substrate 110 be a silicon substrate, because fine channels can be formed with good accuracy. Further, when the first substrate 110 and the third substrate 160 are bonded by anodic bonding, a glass substrate may be used as the third substrate 160.

FIG. 5 shows a droplet discharging device as a comparative example for explaining the effect of the present invention.

Figure 5A:
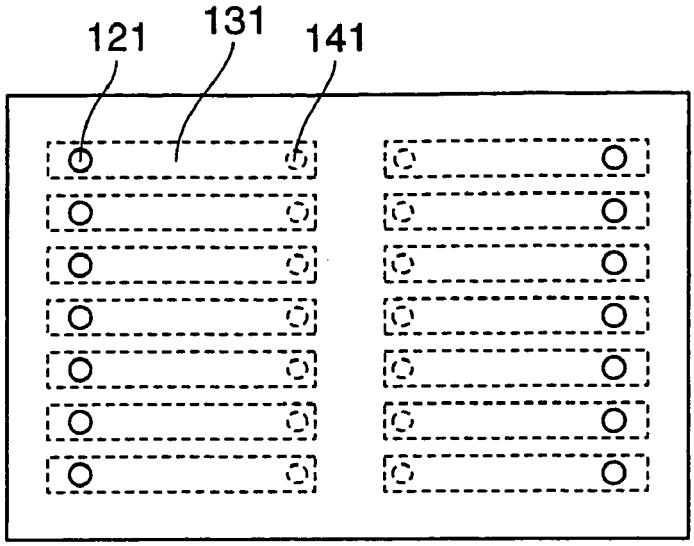
FIG. 5 illustrates the droplet discharging device of a comparative example.
Figure 5B:
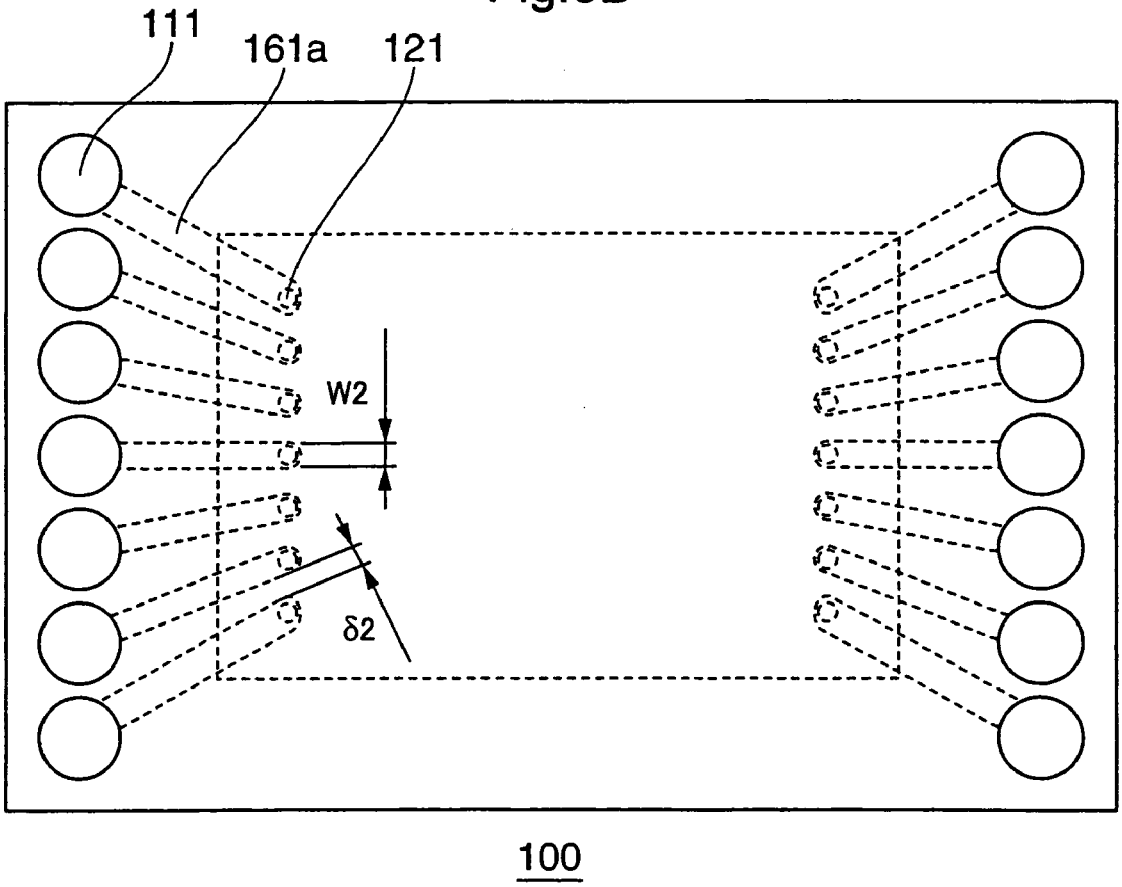

FIG. 5A illustrates a head portion as a comparative example in which the supply openings are disposed in a linear fashion. FIG. 5B illustrates a droplet discharging device as a comparative example for explaining the mutual arrangement of supply openings and liquid reservoir portions.

When a plurality of supply openings 121 are disposed in a linear fashion according to the spacing between the nozzle holes, as shown in FIGS. 5A, B, if the prescribed wall thickness δ2 between the channels 161*a* is ensured, the channel width W2 of the channels 161*a* is restricted. Therefore, the reduction in the channel width W2 increases the channel resistance and the discharge ability of liquid drops with a high viscosity is decreased. The resultant problem is that a limitation is placed on the types of liquid that can be discharged. Further, as shown in FIG. 5B, when all the liquid reservoir chambers 111 are disposed on one side of the arrangement of the supply openings 121, the outer shape of the droplet discharging device increases in size, operability of the device is degraded, and cost thereof is increased.

Another problem is that because of the spread of the channel lengths, uniform discharge characteristic cannot be obtained for all the nozzles due to the difference in the channel resistance caused by the difference in the channel length.

The droplet discharging device in accordance with the present invention resolves the aforementioned problems.

What is claimed is:

1. A droplet discharging device comprising:

a first substrate comprising a plurality of reservoir chambers for holding a liquid;

a second substrate comprising a plurality of discharge units comprising supply openings for receiving a supply of the liquid stored in said reservoir chambers, pressurizing chambers for applying a pressure to the liquid supplied from said supply openings, and discharge openings for discharging the liquid pressurized in the pressurizing chambers to the outside; and a third substrate sandwiched between said first substrate and said second substrate and comprising channels for connecting said plurality of reservoir chambers with said plurality of supply openings corresponding thereto, wherein the plurality of supply openings provided in said second substrate are arranged such that the relative positions thereof have a zigzag disposition, wherein said second substrate comprises an electrode substrate having electrodes on the surface, a pressurizing chamber substrate disposed via a small gap opposite said electrode substrate and comprising pressurizing chambers with a pressure inside thereof adjusted by the displacement of diaphragms oscillating under the effect of an electrostatic force induced by said electrodes, and a nozzle substrate disposed on the opposite side of said pressurizing chamber substrate and having nozzle holes for discharging said liquid filling said pressurizing chambers to the outside.

2. The droplet discharging device according to claim 1, wherein the channels connected to the plurality of supply openings disposed in a zigzag fashion are formed alternately on both sides of the arrangement of said supply openings.

3. The droplet discharging device according to claim 1, wherein all the channels formed in said third substrate have an almost the same length.

4. The droplet discharging device according to claim 1, wherein one of said first substrate and said third substrate is composed of glass, the other of said first substrate and said third substrate is composed of silicon, and said first substrate and said third substrate are bonded by anodic bonding.

5. The droplet discharging device according to claim 1, wherein some of said channels are formed in the first substrate.

6. The droplet discharging device according to claim 1, wherein the channels formed in said first substrate and/or said third substrate are formed by using photolithography technology.

7. An apparatus for manufacturing a microarray comprising:

the droplet discharging device according to claim 1, and positioning means for adjusting relative positions of said droplet discharging device and the substrate for fixing the liquid drops discharged from said droplet discharging device.

8. A method for manufacturing a microarray by which liquid drops are discharged onto a substrate and a microarray is manufactured by using the droplet discharging device according to claim 1.

* * * * *